United States Patent [19]

Fischer et al.

[11] 3,933,951

[45] Jan. 20, 1976

[54] CARBURETOR

[75] Inventors: Earl R. Fischer, Rochester; Roland S. Taylor, Fairport, both of N.Y.

[73] Assignee: General Motors Corporation, Detroit, Mich.

[22] Filed: July 1, 1974

[21] Appl. No.: 484,705

[52] U.S. Cl. ..... 261/67; 261/69 R; 261/121 B; 261/DIG. 74

[51] Int. Cl.[2] ..... F02M 7/20

[58] Field of Search ..... 261/121 B, DIG. 74, 69 R, 261/67

[56] References Cited

UNITED STATES PATENTS

| | | | |
|---|---|---|---|
| 1,675,344 | 7/1928 | Guthrie | 261/67 |
| 2,922,629 | 1/1960 | Germano et al. | 261/69 R |
| 3,575,390 | 4/1971 | Bickhaus et al. | 261/121 B |
| 3,618,907 | 11/1971 | Severn | 261/69 R |
| 3,685,502 | 8/1972 | Oberdorfer, Jr. | 261/DIG. 74 |
| 3,744,346 | 7/1973 | Miner et al. | 261/DIG. 74 |
| 3,800,766 | 4/1974 | Schubeck | 261/67 |
| 3,859,397 | 1/1975 | Tryon | 261/121 B |

*Primary Examiner*—Tim R. Miles
*Attorney, Agent, or Firm*—C. K. Veenstra

[57] ABSTRACT

In a carburetor having a two-stage power valve and an off-idle air bleed, a lean air-fuel mixture may be supplied when it is desirable to operate in a lean mode for optimizing an exhaust gas oxidizing reactor while a rich air-fuel mixture may be provided when it is desirable to operate in a rich mode for optimizing an exhaust gas reducing converter. In the rich mode means comprising a selectively energizable solenoid control closes the off-idle air bleed and opens the first stage of the power valve thereby enriching both off-idle and open throttle air-fuel mixtures. The power valve is also operated by an induction pressure responsive piston, and at high induction pressures both stages may be opened during lean mode operation and the second stage may be opened during rich mode operation for wide open throttle enrichment.

1 Claim, 4 Drawing Figures

CARBURETOR

This invention relates to a carburetor having a two-stage power valve and an off-idle air bleed wherein means energizable to open the first stage of that power valve and to close the air bleed are provided for enriching the off-idle and open throttle air-fuel mixtures.

Internal combustion engine carburetors are often provided with a power enrichment system comprising an induction pressure responsive piston which opens a power valve during wide open throttle operation to increase fuel flow from the fuel bowl to the engine. In one carburetor model, the pressure signal is communicated from the induction passage to the top of the piston so that when the signal is below a selected level the piston is raised and a spring closes the valve to reduce fuel flow to the engine. However, when the pressure signal is above that selected level — during wide open throttle operation — a return spring lowers the piston which then opens the valve to increase fuel flow to the engine.

Also, prior art power enrichment systems on occasion include two-stage power valves which sequentially open when the induction pressure signal achieves different selected levels. For example, when that pressure signal is below both levels the piston is raised and a pair of springs close both valves to curtail fuel flow to the engine. However, when that pressure signal increases above the first signal level but does not attain the second level the return spring lowers the piston a selected first amount which then opens the first stage valve to increase fuel flow to the engine for partial enrichment. When that pressure signal further increases above both selected levels, for example, during wide open throttle operation, the return spring lowers the piston an additional amount to open both power valves and further increase fuel flow to the engine.

It is well to point out that carburetors are often provided with an adjustable off-idle air bleed passage which opens into the idle fuel passage. Control of the air flow through the off-idle air bleed passage determines the air-fuel mixture ratio when the throttle is in an off-idle position.

Now that increased emphasis has been directed toward emission control, various exhaust gas conversion means have been proposed for oxidizing or reducing undesirable exhaust gas constituents. For example, both catalytic converters and thermal reactors have been proposed as particularly effective means of oxidizing such unburned exhaust constituents as carbon monoxide and unburned hydrocarbons. The lean exhaust air-fuel mixture required by such units for satisfactory oxidation reactions is most economically achieved by delivering a lean induction airfuel mixture to the engine.

It is also well known that catalytic converters for reducing oxides of nitrogen require a rich exhaust air-fuel mixture to maintain a reducing atmosphere in the converter; such a mixture is most economically achieved by delivering a rich induction air-fuel mixture to the engine.

This invention provides a carburetor which selectively controls the exhaust gas composition by curtailing fuel flow to change the carburetted air-fuel ratio, delivered to the engine, to lean during the oxidizing catalytic converter or thermal reactor mode of operation and by supplying additional fuel flow to enrich the carburetted air-fuel mixture during the reducing catalytic converter mode of operation. In addition, the carburetor provided by this invention allows for conventional power enrichment during wide open throttle operation of the engine.

This invention is especially suited for use in a system, such as that set forth in copending Ser. No. 312,574 filed Dec. 6, 1972, now U.S. Pat. No. 3,824,788 which combines oxidizing and reducing exhaust devices for most effective operation. During a rich-carburetted mode of operation exhaust gases first pass through a reducing catalyst bed, air is then added to the exhaust gases, and the exhaust gases are thereafter passed through an oxidizing catalyst bed. During an alternative lean-carburetted mode of operation, exhaust gases including excess oxygen pass through only an oxidizing thermal reactor, and the catalyst beds are bypassed to extend their effective life. As indicated above, the desired exhaust gas composition can be provided most economically by controlling the carburetted air-fuel mixture.

Specifically, this invention provides a carburetor having an energizable control which mechanically moves a slightly modified power enrichment piston to a first stage position to open the first stage of a two-stage power valve. This increases fuel flow when it is desirable to go from a lean mode to a rich mode. The power piston remains responsive to the pressure signal from the induction passage to open the second stage of the power valve and thereby further enrich the air-fuel mixture for conventional power enrichment. When energized, this control simultaneously closes the off-idle air bleed passage to enrich the off-idle air-fuel mixture ratio so that the rich mode of operation may be maintained from off-idle to open throttle operation.

When it is desirable to switch from the rich mode to the lean mode of operation, the energizable control is deenergized to allow the power enrichment piston to respond only to variation in induction pressure. During low induction pressure operation the two stages of the power valve close and curtail fuel flow to the engine, while during high induction pressure operation either or both stages may be opened to provide power enrichment. In addition, upon deenergization the control opens the off-idle bleed passage to allow air to lean the off-idle air-fuel mixture ratio.

It should be pointed out that in both the leandeenergized and the rich-energized modes of operation, transient power enrichment may be effected when desirable to operate at wide open throttle during, for example, acceleration.

The foregoing and other objects and advantages of this invention will be made apparent by referring to the remainder of the specification and to the drawings in which.

Figure 1:
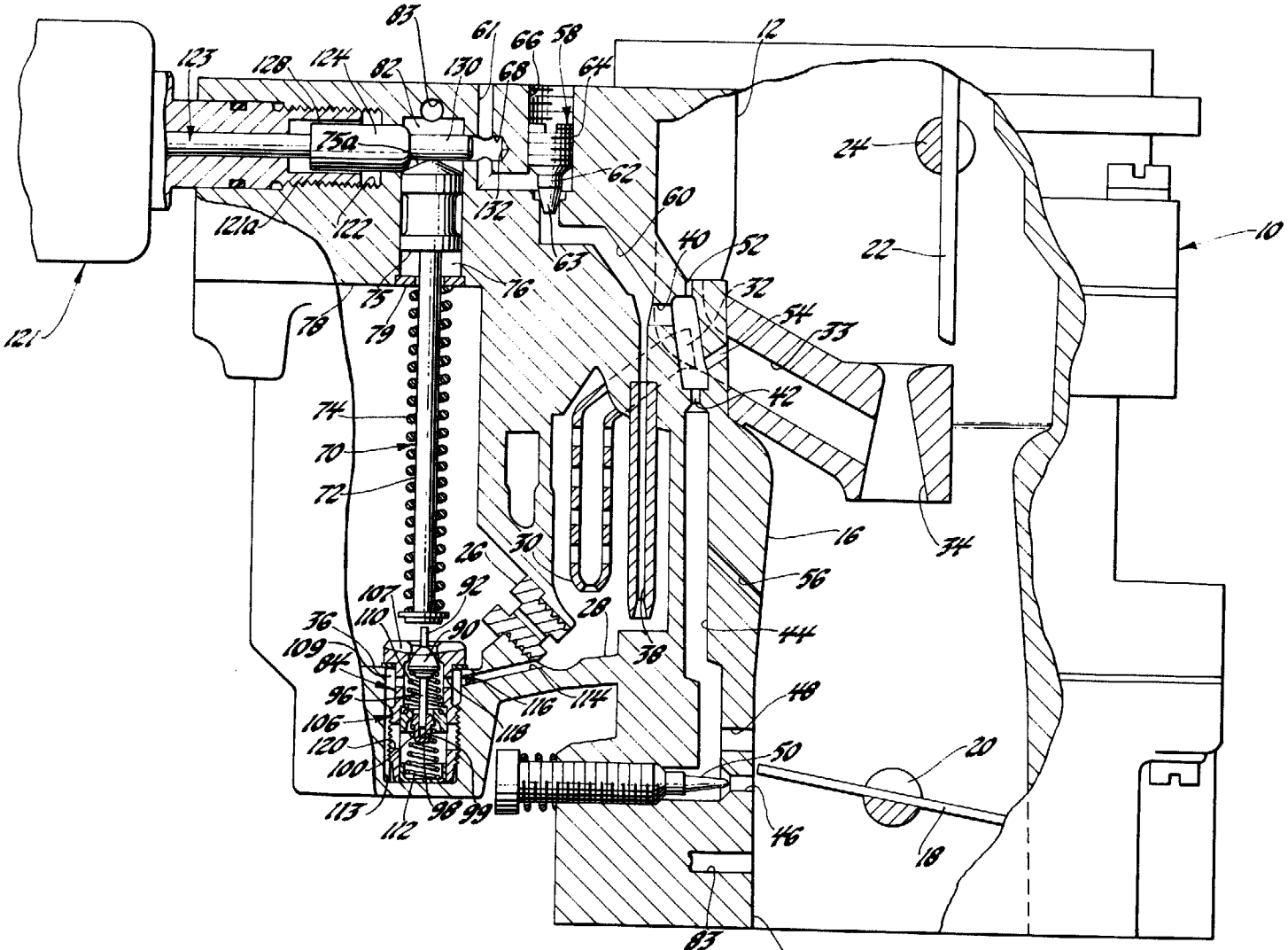
FIG. 1 is a sectional view of this invention incorporating the selectively energizable fuel control and power enrichment system.

Referring to FIG. 1, a carburetor 10 comprises a primary air inlet 12 which inducts air from the ambient atmosphere, a mixture outlet 14 for supplying an air-fuel mixture to the engine and a conventional venturi 16 for providing an air flow pressure signal to the main fuel metering system (to be described). A throttle valve 18 is rotatably disposed on a throttle shaft 20 for controlling air flow through air inlet 12. A conventional choke valve 22 is rotatably disposed on a choke valve shaft 24.

The conventional main metering system comprises a main metering jet 26, a main fuel well 28, a main well tube 30, a nozzle 32, an aspirator bleed passage 33 (shown schematically), and an associated boost venturi 34 for supplying fuel from fuel bowl 36 to air inlet 12 in a conventional manner. Idle fuel is drawn from main well 28 through an idle metering tube 38, a crossover passage 40, a restriction 42, and a vertical passage 44 to a curb-idle discharge port 46 and an off-idle discharge port 48. When the throttle is closed, all idle fuel flow is directed through port 46 at a rate controlled by a metering valve 50. As throttle 18 is opened, it traverses port 48 and subjects that port to subatmospheric induction passage pressure. Additional idle fuel is then discharged into mixture conduit 14 from port 48. Conventional impact and velocity air bleeds 52 and 54 are provided in the crossover passage 40 and a conventional lower idle air bleed 56 is provided into vertical passage 44; these air bleeds 52, 54, and 56 allow air to be mixed with the fuel drawn from main well 28 to provide an air-fuel emulsion in vertical passage 44 and to control its discharge from ports 46 and 48.

Figure 2:
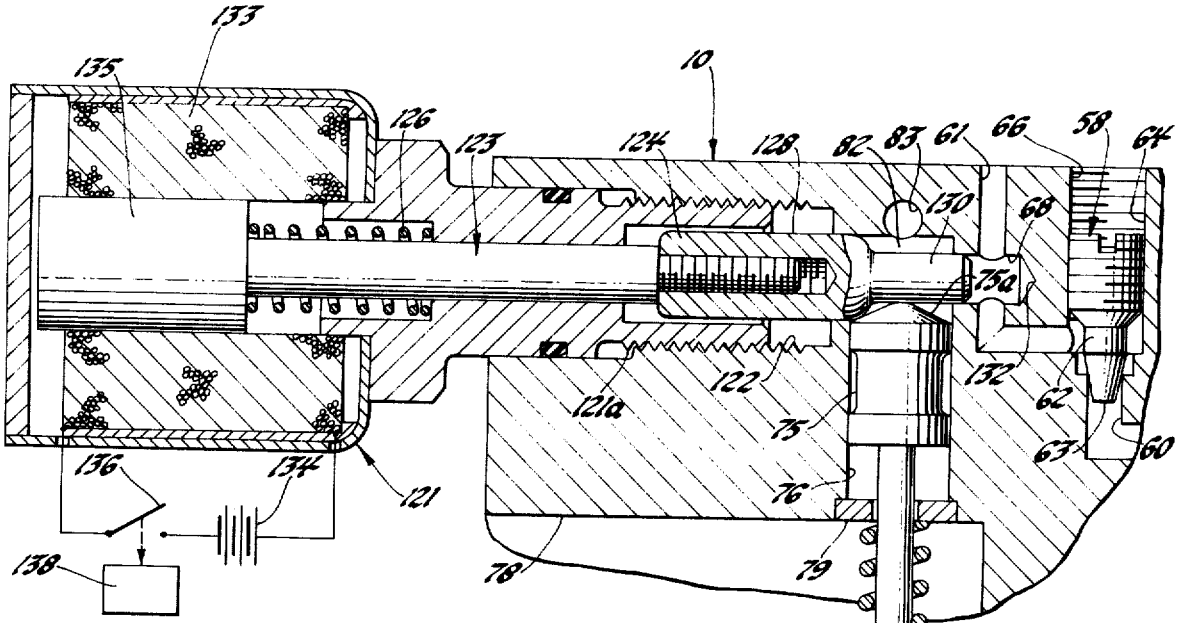
FIG. 2 is an enlarged view of a portion of the FIG. 1 carburetor showing details of the selectively energizable solenoid and fuel control.

Referring now to FIGS. 1 and 2, an off-idle air bleed 58 has a passage 60 extending to crossover passage 40 and a passage 61 extending to the atmosphere. An adjustable valve 62, having a tapered portion 63 associated with air bleed 58, controls the amount of air bled past portion 63 to passage 60 to control off-idle fuel flow and thus control the off-idle air-fuel ratio.

Valve 62 is formed as a portion of an adjusting screw 64 threadedly received in a threaded bore 66 in carburetor 10. Rotation of screw 64 results in axial movement of valve 62 and tapered portion 63 and regulation of the amount of air bled through air bleed adjusting screw 58.

A power enrichment piston assembly 70 provides the means of actuation of power valve assembly 84 to provide extra fuel to meet power requirements under heavy engine load and wide open throttle operation. The power piston stem 72, urged downwardly by a spring 74, has a piston portion 75 and uppermost ramp portion **75*a* located in a cavity 76 formed in the cover 78 of the fuel bowl 36. A guide end 79 closes the lower end of cavity 76 and admits atmospheric pressure to the bottom of piston portion 75. Piston portion 75 also defines an upper signal chamber 82 within cavity 76. Chamber 82 receives an induction passage pressure signal through a passage 83 extending from mixture outlet 14 below throttle 18. Power piston 70 is held in the uppermost position as shown during idle and cruise conditions, since the relatively low induction pressure signal in chamber 82 raises and holds the power piston against the downward urging of spring 74**.

Figure 3:
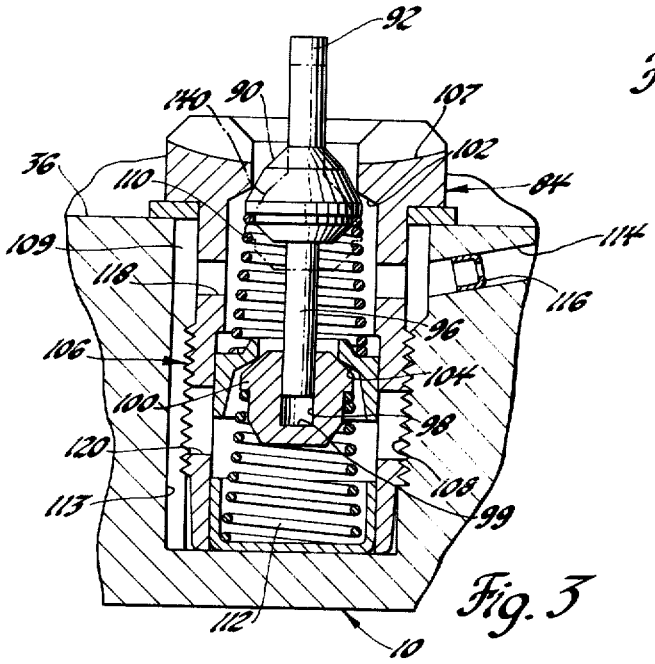
FIG. 3 is a view of the two-stage power valve further enlarged to show the details of its construction and showing the positions of the first stage valve when the solenoid is deenergized and energized.

A two-stage power valve assembly 84 is shown in FIGS. 1 through 3 and comprises a first-stage valve member 90 having an upwardly extending stem 92. It is important to note that piston stem 72 does not engage stem 92 when the piston is in the raised position shown. A pin 96 extends downwardly from the center of the first-stage valve member 90 and rides in an inner wall

98 of a lower, second-stage valve member 100 to provide a lost-motion connection between valves 90 and 100. A bottom 99 of well 98 is adapted to be engaged by stem 96 for moving valve 100 downwardly.

Associated with first-stage valve 90 and second-stage valve 100, are respectively, a first-stage valve seat 102 and a lower, second-stage valve seat 104. Seats 102 and 104 are, respectively, formed and pressed into a threaded insert member 106, having a transverse installation slot 107. Insert 106 is carried by a threaded well 108 in the bottom of the fuel bowl 36. An annular relief 109 is formed as part of threaded well 108 and surrounds insert member 106 for fuel flow therearound. A pair of axially disposed springs 110, 112 urges first-stage valve member 90 and second-stage valve member 100 upwardly against their respective seats 102, 104. A channel 113 down one side of relief 109 receives fuel from the bottom of well 108.

First-stage valve member 90 and second-stage valve member 100 provide fuel flow to main well 28 through a fuel supply passage 114 having a rich limit restriction 116. When first-stage valve member 90 is unseated from seat 102, fuel flow is provided through a plurality of restrictive apertures 118 formed in insert member 106, through restriction 116 and main well 28, and thus to the mixture conduit 14. It should be noted that restriction 116 is larger than apertures 118, which thus limit this first stage of fuel flow. When second-stage valve member 100 is also opened, additional fuel flow is provided through a plurality of unrestrictive apertures 120 whereby restriction 116 thus controls flow from both the first and the second stages of power valve 84.

It is well known that increases in engine load increase the pressure in the induction passage. When a selected pressure signal level in chamber 82 is attained power piston spring 74 becomes effective to move stem 72 downwardly and lowers first-stage valve member 90 to allow additional fuel to flow through calibrated restrictions 118 to main well 28. When a higher or second selected signal level is attained in chamber 82, indicative of an increased power requirement as the throttle is opened completely, stem 92 is lowered further by spring 74. In this manner, stem portion 96 engages the bottom 99 of well portion 98 and moves valve member 100 away from seat 104 sc that additional fuel is provided. Restriction 116 will be effective to limit that flow of fuel so that the carburetted air-fuel ratio does not become overly rich. Thus, the cumulative fuel flow provided by the combined, staged operation of this two-stage power enrichment system supplements the fuel passing through main metering jet 26 to give the proper mixture ratio required for different levels of power operation. It should be made apparent that the construction heretofore described is conventional and is shown in the prior art.

Referring again to FIG. 2, a solenoid actuator 121 is provided to engage ramp **75*a* of piston portion 75 and thus lower power piston assembly 70 the amount necessary to lower valve member 90 from seat 102 and provide additional fuel through restrictions 118 to main well 28. Solenoid actuator 121** is energized when required to change the carburetted air-fuel ratio from a lean mixture to a rich mixture.

Solenoid actuator 121 comprises a threaded portion **121*a* adapted to engage a threaded well 122 formed in carburetor 10, and includes a movable central armature member 123 reciprocable therein. Armature 123** carries an adjustable contoured member 124 which extends rightwardly, but a spring 126 urges armature 123 and member 124 leftwardly into the deenergized position as shown in FIG. 2. Adjustable member 124 comprises a large first portion 128 for engaging ramp 75*a* and a smaller valve portion 130 for closing passage 68. For improved sealing of passage 68 valve portion 130 may have an associated seat 132 formed in the wall of passage 68. Thus, when valve portion 130 engages seat 132 passage 68 is closed off to prevent air flow therethrough. Accordingly, no air bleeds past adjustable off-idle bleed 58 to lean the off-idle air-fuel mixture when valve portion 130 closes passage 68.

An annular solenoid coil 133 is connected to an external power source 134 for moving a core portion 135 of central armature 123. A series switch 136 controls the energization of coil 133 and is selectively operated by a sensor device 138 which closes switch 136 when it is desirable to change the carburetted air-fuel ratio from lean to rich. Sensor 138 may be responsive to, for example, exhaust gas temperature, reactor wall temperature or catalyst temperature. Alternatively, it may be preprogrammed to selectively operate switch 136 when a variation in the carburetted air-fuel ratio is desired.

For operating in the lean mode, solenoid actuator 121 is deenergized by opening switch 136 so that spring 126 moves armature 123 to the position shown in FIG. 2. Thus, passage 68 is unrestricted by valve portion 130 and air may bleed into the fuel in passage 40. This leans the off-idle air-fuel mixture. Simultaneously, piston portion 75 of power piston 70, when raised, abuts only valve portion 130 of solenoid actuator 121. This permits power valve 84 to close, thus curtailing fuel flow to main well 28.

Figure 4:
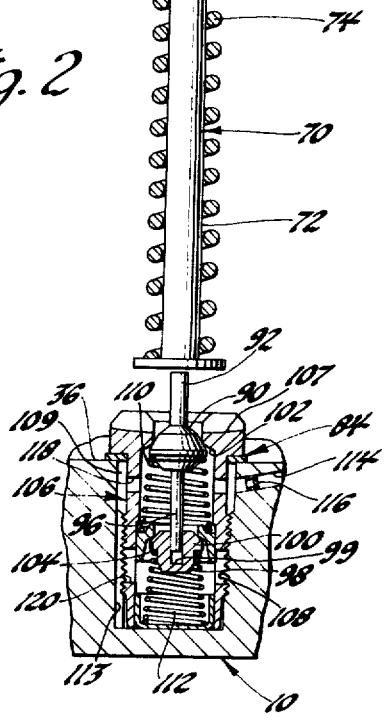
FIG. 4 shows the carburetted air-fuel ratio versus induction pressure characteristics of this carburetor.
Figure 4:
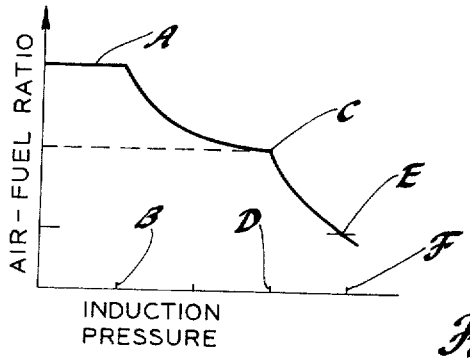

The operation of this carburetor and its associated fuel control is shown in FIG. 4, which illustrates the effect of increasing induction pressure (increasing load) on the carburetted air-fuel ratio. During off-idle and light load open throttle operation, the air-fuel mixture is maintained at a lean ratio A dictated by the size of main jet 26. Above a selected pressure signal level B power piston assembly 70 is lowered by spring 74 and opens first-stage valve member 90 to the position 140 indicated by the dotted lines in FIG. 3. The increased fuel flow provided through restrictions 118 provides medium load power enrichment, decreasing the air-fuel mixture ratio from A to C. When second signal level D is exceeded, stem 96 of first-stage valve member 90 engages bottom 99 of well 98 and thus opens second-stage valve member 100. The increased fuel flow provided through apertures 120 provides a wide open throttle power enrichment by decreasing the mixture ratio from C to E.

Thus, it should be apparent that while operating in the lean reactor mode this invention proportions fuel flow to air flow in a manner which not only normally maintains the exhaust at a lean air-fuel ratio for optimum oxidation efficiency in the reactor, but also meets engine power requirements throughout the operating range.

For operation in a rich converter mode switch 136 is closed and solenoid actuator 121 is energized to shift armature 123 rightwardly. Portion 128 engages ramp 75*a* and lowers power piston assembly 70 to a first stage position in which valve member 90 is opened as indicated by the dashed lines 140 in FIG. 3. The increased fuel flow provided through restrictions 118 enriches the mixture from ratio A to ratio C throughout the range of light and medium load engine operation. In the converter mode of operation this rich air-fuel ratio C optimizes the conversion efficiency of the reducing catalytic converter.

As the induction pressure signal increases above level D, power piston assembly 70 is further lowered by spring 74 to open valve member 100. The increased fuel flow thereby provided through apertures 120 will meet heavy load or power requirements of the engine. This is shown in FIG. 4, wherein increasing the induction pressure signal from D to F decreases the carburetted air-fuel mixture ratio from C to E.

It should also be noted that when solenoid actuator 121 is energized for operation in the rich converter mode, valve portion 130 sealingly engages seat 132 in passage 68 and closes the air supply to off-idle bleed 58. This reduces the air bled into the fuel in passage 40 and thus increases fuel flow through ports 46, 48 to the mixture conduit 14. Accordingly, the off-idle air-fuel mixture to the engine is enriched to assure that a rich mixture is maintained during off-idle operation.

What is claimed is:

1. A carburetor comprising an air inlet for air flow to an engine, a throttle disposed in said air inlet for controlling flow therethrough, a fuel bowl, an idle fuel passage extending from said fuel bowl to said air inlet adjacent said throttle for delivering fuel thereto, a bleed passage opening from the atmosphere to said idle fuel passage for bleeding air to said idle fuel passage to create an air-fuel emulsion therein, a main fuel passage extending from said fuel bowl to said air inlet upstream of said throttle for delivering fuel thereto, valve means in said main fuel passage, said valve means having a lean position permitting the rate of fuel flow through said main fuel passage to said air inlet which will create a part throttle air-fuel mixture leaner than stoichiometric, an intermediate position permitting the rate of fuel flow through said main fuel passage to said air inlet which will create a part throttle air-fuel mixture slightly richer than stoichiometric, and a rich position permitting the rate of fuel flow through said main fuel passage to said air inlet which will create a full throttle air-fuel mixture substantially richer than stoichiometric, a pressure responsive piston for positioning said valve means, a spring biasing said piston to position said valve means in said rich position, a signal passage subjecting said piston to the pressure in said air inlet downstream of said throttle whereby said piston overcomes the bias of said spring to position said valve means in said lean position when such pressure is below a selected value and to position said valve means in said intermediate position when such pressure is above said selected value but below another value, an arm reciprocable between lean and rich modes, said arm having an actuator portion engageable with said piston when said arm is in said rich mode for causing said piston to position said valve means in said intermediate position even through the pressure in said air inlet downstream of said throttle may be below said selected value, said arm further having a valve portion receivable in said bleed passage when said arm is in said rich mode for obstructing air flow therethrough to thereby enrich the off-idle air-fuel mixture created by fuel flow through said idle fuel passage to said air inlet, and means for reciprocating said arm between said lean mode and said rich mode whereby when said arm is in said rich mode said actuator portion causes said piston to position said valve means in said intermediate position to provide a part throttle air-fuel mixture slightly richer than stoichiometric and said valve portion obstructs said bleed passage to provide an enriched off-idle air-fuel mixture, whereby when said arm is in said lean mode said actuator portion permits said piston to position said valve means in said lean position to provide a part throttle air-fuel mixture leaner than stoichiometric and said valve portion permits air flow through said bleed passage to provide a leaned off-idle air-fuel mixture, and whereby said piston may position said valve means in said rich position to provide a full throttle air-fuel mixture substantially richer than stoichiometric irrespective of the mode of said arm.

* * * * *